United States Patent [19]

Packham

[11] 4,316,310

[45] Feb. 23, 1982

[54] RAG RUG LOOM

[76] Inventor: Jackie F. Packham, 6905 Wisconsin Ave., La Mesa, Calif. 92041

[21] Appl. No.: 43,450

[22] Filed: May 29, 1979

[51] Int. Cl.[3] ..... D03D 29/00

[52] U.S. Cl. ..... 28/149; 139/34

[58] Field of Search ..... 28/149, 150, 151, 152; 289/18.1; 139/29, 33, 34; 38/102.91

[56] References Cited

U.S. PATENT DOCUMENTS

| | | | |
|---|---|---|---|
| 1,313,765 | 8/1919 | Traum | 28/151 |
| 2,219,268 | 10/1940 | Marcos | 28/149 |
| 2,263,916 | 11/1941 | Boyle | 28/149 |
| 2,540,383 | 2/1951 | Tiller et al. | 28/149 |
| 3,018,801 | 1/1962 | Coon et al. | 139/29 |
| 4,072,173 | 2/1978 | Markowitz et al. | 139/34 |

FOREIGN PATENT DOCUMENTS

| | | | |
|---|---|---|---|
| 1019082 | 10/1952 | France | 139/33 |

*Primary Examiner*—Henry Jaudon

*Attorney, Agent, or Firm*—Charles C. Logan, II

[57] ABSTRACT

A rag rug loom comprising a frame having a pair of laterally spaced longitudinal side members, and a pair of laterally spaced transverse end members that are connected to the respective opposite ends of the longitudinal side members. A first transverse platen is positioned adjacent one of the transverse end members and a bolt member passes through aligned bores in the respective transverse end member and platen and has a wing nut threaded on its end. A second transverse platen is positioned adjacent the other transverse end member and it has a pair of bolt members passing through aligned bores in the respective transverse end member and platen and each have a wing nut threaded on its end.

1 Claim, 5 Drawing Figures

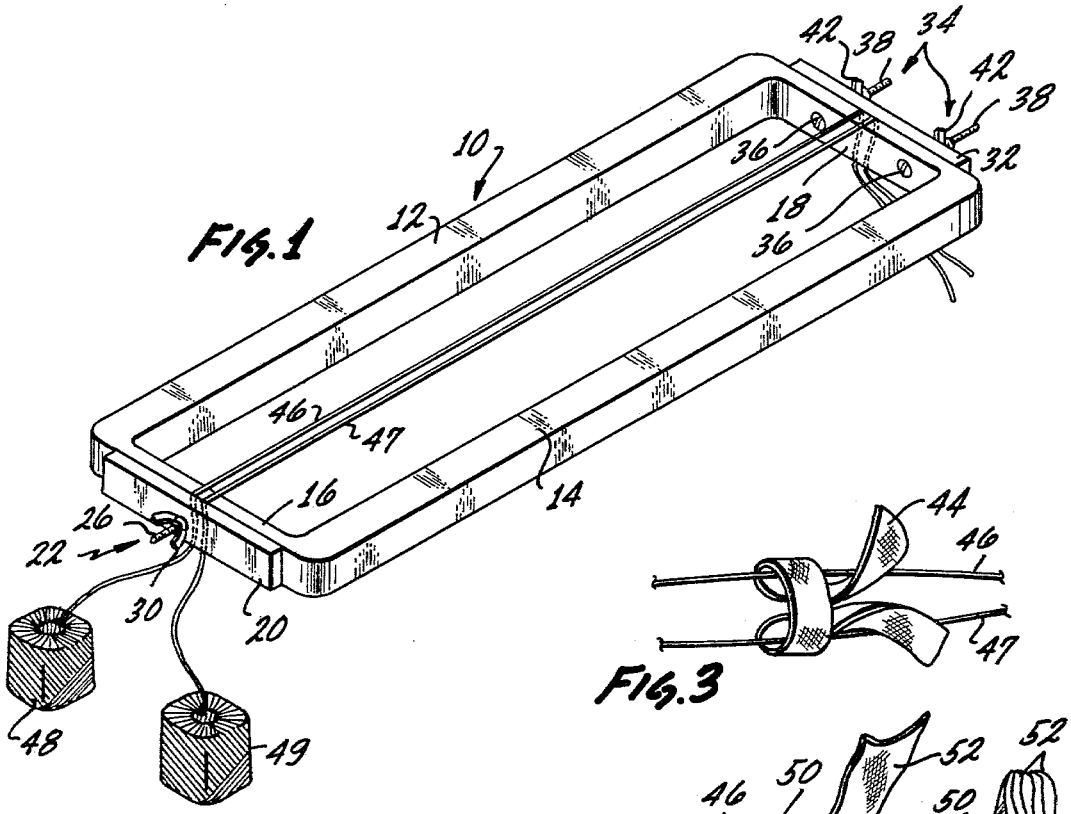
FIG. 1
FIG. 3
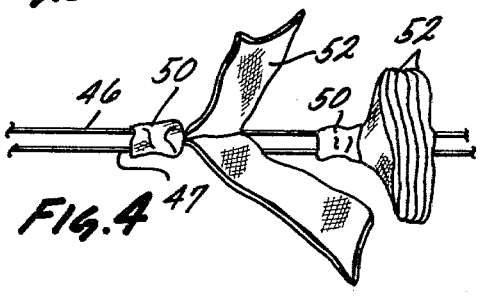
FIG. 4
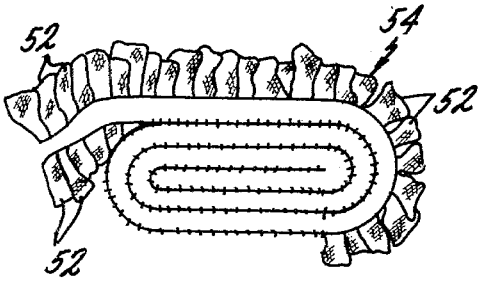
FIG. 5
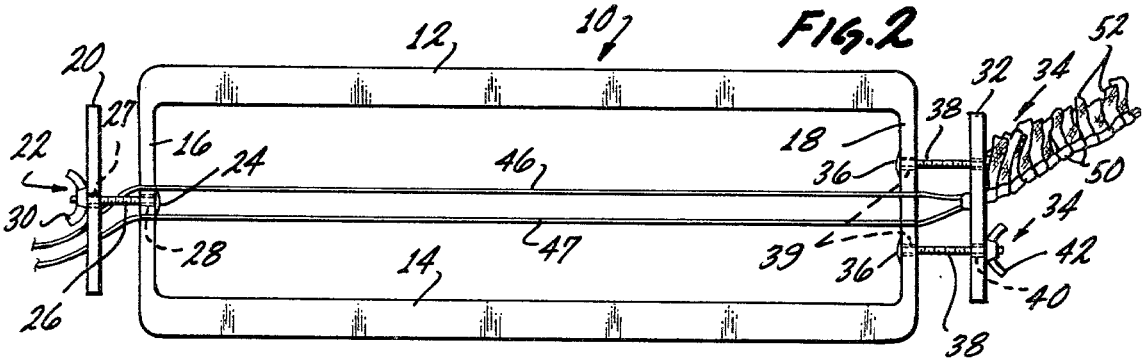
FIG. 2

RAG RUG LOOM

BACKGROUND OF THE INVENTION

This invention relates to a loom and more particularly to a loom used for making strips that are sewn together to form a rag rug.

In the past many different types of carpet weaving frames have been devised. One example of such a frame is illustrated in U.S. Pat. No. 2,219,268. It has a frame having spaced pairs of bars thereon around which strips of material can be wound and then sewn to a pair of strands. The pairs of bars facilitate cutting the strips between the bars of each pair. After this occurs the strands are sewn together to form a carpet or rug with the cut portions of the material extending upwardly from the base formed by the strands.

Another type of a loom is illustrated in U.S. Pat. No. 2,263,916. This loom is also used for making strips for rugs. It has a long and narrow base to which is attached at one end an open topped box. The box is large enough to hold two full balls of warp cord. At the other end of the base board is rigidly mounted a warp clamp post. Also mounted on the base board and adjacent the open top box is a warp cord tightening device. The string from the open topped box is threaded through the warp cord tightening device and has its end secured in the warp post. Strips of fabric are then looped over the string with the free ends pulled upwardly beteen the strings and drawn tight as the strip is pulled toward the warp post. After continually adding strips of fabric to the spring in the above described manner a strip is formed that can be used to make a rag rug.

It is an object of the invention to provide a novel rag rug loom that is inexpensive, simple to make and use as well as to provide a loom that is highly efficient in its work.

It is also an object of the invention to provide a novel rag rug loom that can be used to make decorative rugs from scraps of fabric that would otherwise be thrown away.

It is a further object of the invention to provide a novel rag rug loom that can be used by persons undergoing rehabilitation to improve their hand eye skills.

It is an additional object of the invention to provide a novel rag rug loom that can be used by small children in school or in craft programs.

SUMMARY OF THE INVENTION

Applicants novel rag rug loom comprises a frame having a pair of laterally spaced longitudinal side members and a pair of laterally spaced transverse end members that are connected to the respective opposite ends of the longitudinal side members. A first transverse platen is positioned adjacent to one of the transverse end members and it has a bolt member passing through aligned bores in the respective members and has a wing nut threaded on its end. A second transverse platen is positioned adjacent the other transverse end member and it has a pair of bolt members passing through aligned bores in the respective members with each bolt having a threaded wing nut on its end.

Prior to using the novel rag rug loom, scrap fabric would be cut into strips one inch wide and about three and a half inches long to provide a good supply of strips. Next the loom would be threaded by tying together the loose ends of two balls of cord and placing the knotted ends between the second transverse platen and its adjacent transverse end member. Next the two wing nuts would be tightened and the two cords of string would be pulled to the opposite end of the loom and run downwardly between the first transverse platen and its adjacent transverse end member. While keeping the cords taut the wing nut of the single bolt would be tightened.

Now the loom is ready to receive the fabric strips. First a strip of material is placed transversly over both cords and then the two loose ends are folded downwardly over the cords with the loose end pulled up between the two cords. As the loose ends are pulled tight, the strip is also pulled toward the second transverse platen. This step is repeated with additional strips until the length of the loom is filled. At this point all three wing nuts are loosened so that the finished strand between the loom transverse end members can be pulled through between the second transverse platen and its respective transverse end member. The two wing nuts adjacent thereto are then tightened and the cords are pulled taut and secured at the other end of the loom by tightening the wing nut passing through the first transverse platen. This operation is repeated until a desired length of rag rug strip is completed. The rug would then be sewn together from the rag rug strip as it is wound in a coiled manner.

DESCRIPTION OF THE DRAWINGS

FIG. 1 is a perspective view of the novel rag rug loom;

FIG. 2 is a top plan view illustrating how the fabric strips are tied onto the cord;

FIG. 3 is a top plan view illustrating the fabric strips tied in a knot on the cords;

FIG. 4 is a top plan view of the novel rag rug loom; and

FIG. 5 is a top plan view of a rug made from the rag rug strips.

DESCRIPTION OF THE PREFERRED EMBODIMENT

The rag rug loom will be described by referring to FIGS. 1–5. The rag rug loom is generally designated numeral 10. It has a pair of laterally spaced longitudinal side members 12 and 14. A pair of laterally spaced transverse end members 16 and 18 are connected to the respective opposite ends of the longitudinal side members 12 and 14.

A transverse platen 20 is positioned adjacent transverse end member 16. A bolt 22 having a head 24 and shank 26 passes through aligned bores 27 and 28 in the respective members and has a wing nut 30 threaded on its end.

Transverse platen 32 is positioned adjacent transverse end member 18 and it has two bolts 34 each having a head 36 and a shank 38 which passes through aligned bores 39 and 40 in the respective members with each having a wing nut 42 threaded on its end.

The frame of the rag rug loom is preferably made of plastic material however it could be made of one of any number of suitable types of material. When made from plastic it can be formed as an integral member.

In FIGS. 2 and 3, the manner for attaching the strip of fabric 44 to the cord 46 and 47 of balls of string 48 and 49 respectively is illustrated. The strips of material when pulled up tight form a knot 50 and a plurality of these knots 50 when pulled together form a rag rug strip 52. The ultimate product which is formed is the rag rug 54 from coiling the rag rug strip 52 and stitching the adjacent edges of the strip.

What is claimed is:

1. A portable rag rug loom consisting entirely of:

an integrally formed elongated closed loop frame of plastic material having a pair of laterally spaced longitudinally extending side members and a pair of laterally spaced transverse end members that have their opposite ends connected to the respective opposite ends of said longitudinally extending side members, said elongated closed loop frame having a length at least twice as long as it is wide, the height of said side members and said end members being substantially the same and there being no structure of said portable rag rug loom that extends upwardly above the top surface of said elongated closed loop frame;

a first transverse platen positioned adjacent one of said transverse end members and having means for tightening said first transverse platen into rigid surface contact with said transverse end member, said means comprising one bolt member passing through aligned bores in said respective end member and platen and having a nut threaded on its end: and a second transverse platen positioned adjacent said other transverse end member and having means for tightening said second transverse platen into rigid surface contact with said transverse end member, said means comprising a pair of bolt members each of which passes through its own set of aligned bores in said respective end member and platen and each having a nut threaded on its end, the loom being adapted to receive at least two cords which extend over end members and between each end member and the associated platen so that when the platens are urged against the end members the cords are held firmly therebetween so as to extend parallel with the side members.

* * * * *